United States Patent [19]

Kuo

[11] Patent Number: 5,057,850

[45] Date of Patent: Oct. 15, 1991

[54] FORESHORTENED LOG-PERIODIC DIPOLE ANTENNA

[75] Inventor: Samuel C. Kuo, Saratoga, Calif.

[73] Assignee: GTE Government Systems Corporation, Stamford, Conn.

[21] Appl. No.: 587,930

[22] Filed: Sep. 24, 1990

[51] Int. Cl.[5] ..... H01Q 11/10

[52] U.S. Cl. ..... 343/792.5; 343/793

[58] Field of Search ..... 343/792.5, 793, 798, 343/810, 812, 822, 807

[56] References Cited

U.S. PATENT DOCUMENTS

| | | | |
|---|---|---|---|
| 3,543,277 | 11/1970 | Pullara | 343/792.5 |
| 3,732,572 | 5/1973 | Kuo | 343/792.5 |
| 4,342,035 | 7/1982 | Anderson et al. | 343/792.5 |
| 4,673,948 | 6/1987 | Kuo | 343/792.5 |
| 4,907,011 | 3/1990 | Kuo | 343/792.5 |

OTHER PUBLICATIONS

D. T. Stephenson, P. E. Mayes, "Log-Periodic Helical Dipole Array," 1963 WESCON Digest.

C. C. Bantin, K. G. Balmain, "Study of Compressed Dipole Antennas," IEEE Transactions on Antennas and Propagations, vol. AP-18, No. 2, Mar. 1970, pp. 195-203.

S. C. Kuo, "Size-Reduced Log-Periodic Dipole Array Antenna," Microwave Journal (GB); vol. 15, No. 12, pp. 27-33, 1972.

D. F. DiFonzo, "Reduced Size Log-Periodic Dipole Antennas," Microwave J., vol. 7, pp. 37-43, Dec. 1964.

E. Young, "Foreshortened Log-Periodic Dipole Array," WESCON Digest (1963).

*Primary Examiner*—Michael C. Wimer

*Assistant Examiner*—Hoanganh Le

*Attorney, Agent, or Firm*—James J. Cannon, Jr.; John F. Lawler

[57] ABSTRACT

A foreshortened log periodic antenna comprising variously configured dipole elements and a tapered feedline is further size reduced with an improved configuration of the dipole with the lowest resonant frequency. By substantially increasing the thickness of that dipole, the overall length of the already size-reduced dipole is further decreased by 8% to 10%.

6 Claims, 2 Drawing Sheets

FORESHORTENED LOG-PERIODIC DIPOLE ANTENNA

BACKGROUND OF THE INVENTION

This invention relates to log-periodic dipole antennas (LPDA) and more particularly to an improvement to an LPDA of the type disclosed in U.S. Pat. No. 4,907,011 (hereinafter '011).

Because the log-periodic dipole antenna ("LPDA"), affords a theoretical infinite bandwidth, LPDAs are invariably proposed when broadband antenna performance is demanded. In practice, the frequency range within which an LPDA is able to operate is limited by the detail of the feed point and the length of the largest dipole, respectively. For a conventional LPDA, the length of the largest dipole is on the order of one half the wavelength of the lowest operating frequency. This physical requirement precludes the use of LPDAs in some circumstances.

The conventional LPDA is defined primarily by two design parameters: Alpha, the enclosed angle, and Tau, the ratio of the distance between adjacent dipoles. Alpha controls the length of the antenna structure, and Tau determines the number of dipole elements. LPDAs with Alpha narrower than 15° and Tau greater than 0.9 generally provide high gain and directivity as well as nearly frequency-independent performance. In addition, for each Alpha there exists a correlatively optimal value of Tau. Deviation from the optimal value tends to result in a degradation in antenna performance. In practice, antenna designs seek to minimize Tau because reduced dipole spacing requires less material and results in shorter assembly time. However, with Alpha less than 15°, the LPDA will tolerate a relatively large range of Tau without significant performance degradation. For this reason, most size-reduction experiments have been conducted using LPDAs with relatively small Alpha.

A number of design techniques for LPDAs with small Alphas have been demonstrated. An example is the reduced-size antenna described in U.S. Pat. No. 3,543,277 to Pullara, entitled "Reduced Size Broadband Antenna." An antenna disclosed therein is characterized by an Alpha of 12° and a Tau of 0.95.

Various other efforts have been directed to the reduction of the size of the LPDAs. (See, for example, Stephenson, "Log-Periodic Helical Dipole Array," *WESCON Digest* (1963); E. Young, "Foreshortened Log-Periodic Dipole Array," *WESCON Digest* (1963); Defonzo, "Reduced Size Log-Periodic Antennas," *Microwave Journal* (December, 1972)). Many resulting techniques were directed to capacitive "T" or "U" loading, or to replacing the linear dipoles with helical dipoles. However, such techniques have been able to achieve a reduction in the width of the LPDAs only at the expense of increased antenna boomlength. This is due to the fact that these types of dipoles exhibit higher Q than conventional dipoles. Consequently, an additional number of "foreshortened dipoles" needs be added to the LPDA structure in order to preserve the LPDA's frequency-independent, or broadband, characteristics. In addition, these techniques tend to increase the design complexity of the LPDA, primarily because foreshortening requires more than the straightforward replacement of linear dipoles of an existing LPDA with reconfigured, foreshortened dipoles. As a result, the design of the foreshortened LPDA has historically involved a large number of "cut and try" processes.

An improved technique subsequently discovered by one of the inventors of the instant invention and disclosed in U.S. Pat. No. 3,732,572 (hereinafter "572") allows simple replacement, on a one-to-one basis, of the linear dipoles of a conventional LPDA with foreshortened counterparts. For further explanation, see Kuo, "Size-Reduced Log-Periodic Dipole Array Antenna," *Microwave Journal* (December, 1972). This technique circumvents the experimental approach to foreshortened LPDA design. (The information contained in the '572 and '011 patents and the technical article authored by the inventor/patentee are incorporated hereunder by reference, as provided in Section 608.01(p) of the Manual of Patent Examining Procedure.)

The theoretical principle supporting the invention disclosed in '572 derives from the electromagnetic analogy that may be drawn between the rectangular waveguide and the slot antenna. As is well known, the cutoff wavelength of the fundamental mode of a rectangular waveguide is twice the width of the waveguide. Furthermore, the cutoff frequency of a ridged waveguide is known to be lower than that of a rectangular waveguide of identical width and height. Because the resonant frequency of a slot antenna is the analog of the waveguide resonant frequency, the antenna resonant frequency may be expected to correspond to the waveguide cutoff frequency. Specifically, the resonant frequency of a slot antenna may be expected to be reduced when its interior profile is formed in the fashion of the cross section of a ridged waveguide. Finally, because a dipole antenna is an analog, as defined by Babinets' principle, of the slot antenna, it is expected that the physical length of the dipole is susceptible of foreshortening when formed in the shape of a ridged waveguide. Empirical investigation has justified the above hypotheses. To wit: The invention embodied in '572 has permitted the physical size of a conventional dipole antenna to be foreshortened by as much as 35 to 40 percent, without significant effect on the antenna's electrical characteristics. Foreshortening is accomplished by imparting to the dipole the interior cross-sectional profile of a ridged rectangular waveguide. However, even with access to the above technique, foreshortening of antennas with Alphas in excess of 45° is difficult to obtain. Heretofore, no practitioner is known to have successfully reduced the width of LPDAs with Alpha greater than or equal to 45° at frequency higher than VHF range, 300 MHz.

The difficulty in foreshortening LPDAs with Alphas about 45° lies with the conventional LPDA itself. As a result, LPDAs with Alpha greater than 45° simply are not commercially available for the microwave frequency range. To date, there has been only limited investigation of the performances and anomalies of LPDAs with large Alpha. (See, for example, Bantin, C. and Balmain, K. "Study of Compressed Log-Periodic Dipole Antennas," *IEEE Transaction on Antennas and Propagation* (March 1970). The incentive to develop an LPDA with large Alpha becomes apparent when it is understood that the boomlength of an LPDA with an Alpha of 45° is approximately one fifth the boomlength of an LPDAs with Alpha 12°. Thus, while numerous efforts have been undertaken to reduce the width of the LPDAs with relatively small Alpha, very little effort has been devoted to the investigation of "short" LPDAs. In fact, conventional LPDAs with large Alpha fail to retain their frequency independence unless special techniques are brought to bear.

When the Alpha of an LPDA is increased, the optimized value of Tau is normally reduced in order to maintain proper spacing between the adjacent dipoles. By doing so, the number of near-resonant dipoles is reduced in proportion to the reduction in Tau. When the number of near-resonant dipoles in the active region is insufficient to radiate a substantial portion of the excitation currents, the residue currents will propagate and excite the 1.5λ or, perhaps, the 2.5λ dipoles. Radiation from these larger dipoles results in deterioration of the frequency-independent characteristics of the LPDAs.

One method which will prevent the larger dipoles from radiating is to increase the feedline characteristic impedance by increasing the spacing of the two-wire balanced feedline. This approach forces a greater proportion of the energy from the feedline into the near-resonant dipoles and therefore reduces the magnitude of the residence currents. As a result, the LPDA typically assumes a mean input impedance of 140 ohms or greater. A broadband transformer is then required to transform the input impedance to 50 ohms. This is very difficult to accomplish at microwave frequencies, especially when the maximum operating frequency approaches 20 GHz.

Another method involves the replacement of the linear dipoles with radiators with lower Q. The triangularly shaped dipole is such a radiator. Its Q decreases as the base of the triangularly shaped dipole increases. Of course, when the base dimension approaches zero, a linear dipole is obtained. These lower Q radiators will couple an enhanced proportion energy from the feedline, with an effect identical to that obtained by introducing additional radiators into the active region. LDPAs with Alpha equal to 45° have been built and tested, and no anomalies were observed. These results indicate that the largest proportion of the excitation currents are radiated by the near 0.5λ dipoles.

A disadvantage of the triangularly shaped dipole is that it resonates at frequencies greater than the resonant frequency of a linear dipole of the same length. For a triangularly shaped dipole that has a height-to-base ratio of 5:1, wherein "height" is defined as one-half of the dipole length, the triangular dipole must be approximately 20% longer than a linear dipole that resonates at the same frequency. Thus, an LPDA which has such triangularly shaped dipoles must be 20% wider and longer than an LPDA with linear dipoles operating over the same frequency range. Clearly this is to be avoided, inasmuch as the purpose of the triangularly shaped dipole is to reduce the size of the antenna structure.

Consequently, what is desired is a heretofore unavailable LPDA configuration for antennas with Alpha approaching 45°. The desired LPDA configuration should be amenable to "foreshortening" techniques such as that disclosed in '572 and '011. An optimal configuration will circumvent the deterioration in broadband performance attendant in the heretofore known techniques. Preferably the chosen technique will eliminate the need for a broadband impedance transformer such as is invoked by approaches involving increased spacing of the balanced feedline. Specifically, to the extent triangular radiating elements are employed, it will be necessary to devise an approach that mitigates the additional length that the triangular radiator must assume in order to resonate at the same frequencies as the linear dipole equivalent.

One form of the antenna comprises a coaxial feedline that includes a first coaxial portion and a second coaxial portion, the antenna elements being disposed, in a predetermined fashion, along the lengths of the respective coaxial portions. The first and the second coaxial portions are juxtapositioned so as to exhibit an axial separation that increases in a direction along the length of the coaxial portions. The characteristic impedance of the feedline also increases along that direction. Antenna elements are disposed along the feedline so that elements of relatively low Q are disposed at positions of relatively low characteristic impedance. Conversely, elements of relatively higher Q are disposed at positions of relatively higher characteristic impedance. More specifically, the antenna consists of two complementary sections with elements disposed in alternately opposite directions from the first and the second coaxial portions.

SUMMARY OF THE INVENTION

The above and other objects of the invention are achieved in one aspect of the invention by an LPDA constrained to a maximum width W dictated in most instances by the length of the antenna element having the lowest frequency. In the preferred embodiment of the invention, the antenna comprises a first group of triangular dipoles having varying heights but substantially mutually equivalent base-to-height ratios. The antenna also has a linear dipole, a third "group," having a length no greater than W. Interposed between the first group of triangular dipoles and the linear dipole is a second group of triangular dipoles having respective base-to-height ratios that decrease in the direction from the first group of triangular dipoles to the linear dipole. The LPDA further has a fourth group of dipoles which are foreshortened, each of the latter comprising a stem portion and a generally rectangular perimetered body portion configured so that the total length of each of the foreshortened dipoles is approximately equal to W. In accordance with this invention, at least the last foreshortened dipole having the lowest resonant frequency of the group (and in some instances more than the last foreshortened dipole) has a thickness substantially greater than that of each of the other foreshortened dipoles, thereby enabling an even greater reduction in width W than has been heretofore possible.

DESCRIPTION OF PREFERRED EMBODIMENT

Figure 1:
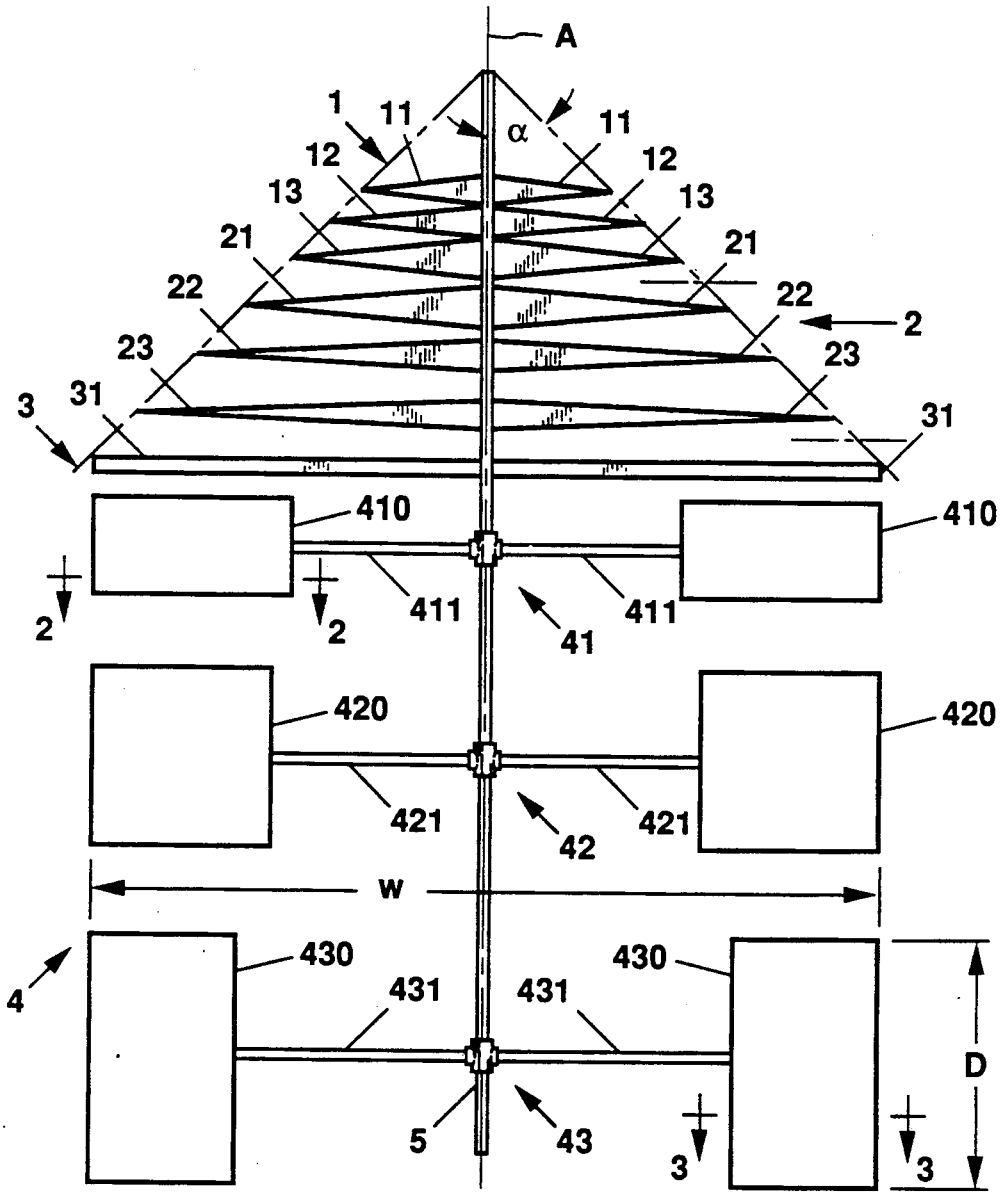
FIG. 1 is a schematic plan view of a log periodic antenna embodying this invention.
Figure 2:
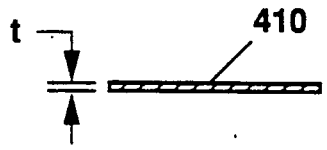
FIGS. 2 and 3 are transverse sections taken on lines 2—2 and 3—3, respectively, of FIG. 1.
Figure 3:
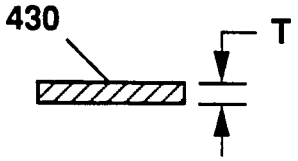

Referring now to the drawings, FIG. 1 shows an LPDA having a longitudinal axis A and comprising an arrangement of triangular dipoles, a single linear dipole, and a series of foreshortened dipoles similar to those disclosed in FIG. 7 of '072, i.e., they have solid or sheet-like conductors. The antenna may be viewed as being divided into four regions. Region 1 includes a group of solid triangular dipoles 11, 12 and 13, of increasing height. Although dipoles 11, 12, and 13, because of their triangular configuration, necessarily have a physical length greater than the length required of their linear dipole equivalents, they present no compromise in the antenna construction inasmuch as their maximum length lies comfortably within the maximum allowable width, W, of the antenna. Dipoles 11, 12, and 13 are characterized by substantially mutually equivalent base-to-height ratios of 0.2.

Region 2 is a transition region that also includes a group of solid triangular dipoles, 21, 22, and 23, of increasing height. However, in contradistinction to the triangular dipoles of region 1, the dipoles of region 2 exhibit a gradually decreasing base dimension and, therefore, a gradually decreasing base-to-height ratio. For example, for an LPDA operating in the 500 MHz to 20 GHz frequency range, the respective base-to-height ratios of dipoles 21, 22, and 23 assume the respective values of 0.16, 0.12, and 0.08.

Region 3 consists of a single linear dipole 31. The dipoles of region 2 offer a smooth transition from the triangular radiators of region 1 to dipole 31. The advantages offered by dipoles 21, 22, 23 derive from the fact that these dipoles are relatively low Q radiators and effect the requisite transformation from the high Q dipoles of region 1 into the single linear dipole. Because the dipoles of region 2 have roughly the same height as the linear dipole equivalents, the transformation from region 1 to the linear dipole of region 3 is brought about within the physical constraints imposed on the design of the antenna. Dipole 31 is illustrated as having a total length roughly equivalent to the maximum allowable width W of the antenna although in some instances its length may be shorter.

Region 4 includes a group of foreshortened, or size-reduced, dipoles, 41, 42 and 43 having the configuration set forth in '011. Each of the foreshortened dipoles includes a rectangularly perimetered preferably solid electrically conductive body portions 410, 420 and 430 attached to feedline 5 through respective stems 411, 421 and 431, respectively.

In accordance with this invention, body portions 430 of dipole 43 are solid conductors having a thickness T substantially greater than the thickness t of dipole body portion 410. In theory, the dimension T has a practical limit equal to the width D of body portion 430; however, in a preferred embodiment of the invention T=0.25", t=0.010" to 0.016", and D=1.1". In another embodiment, dipole body portion 420 may have a thickness intermediate that of body portions 430 and 410 of dipoles 43 and 41, respectively. For example, t for dipole 42 may be 0.120" when T=0.25" for dipole 43 and the thickness of dipole 41 is about 0.010" to 0.015".

Through utilization of the antenna design techniques disclosed herein, it has been possible to construct an LPDA, constrained to a maximum dimension 6" long and no greater than 5½" wide, that provides frequency-independent performance within the aforementioned range of 500 MHz to 20 GHz. It is clear that, given the above description, an antenna designer possessing merely the skill of a routineer would be able to apply the subject invention to other frequency ranges as directed. Such application is clearly within the scope of this invention as contemplated by the appended claims.

Figure 4:
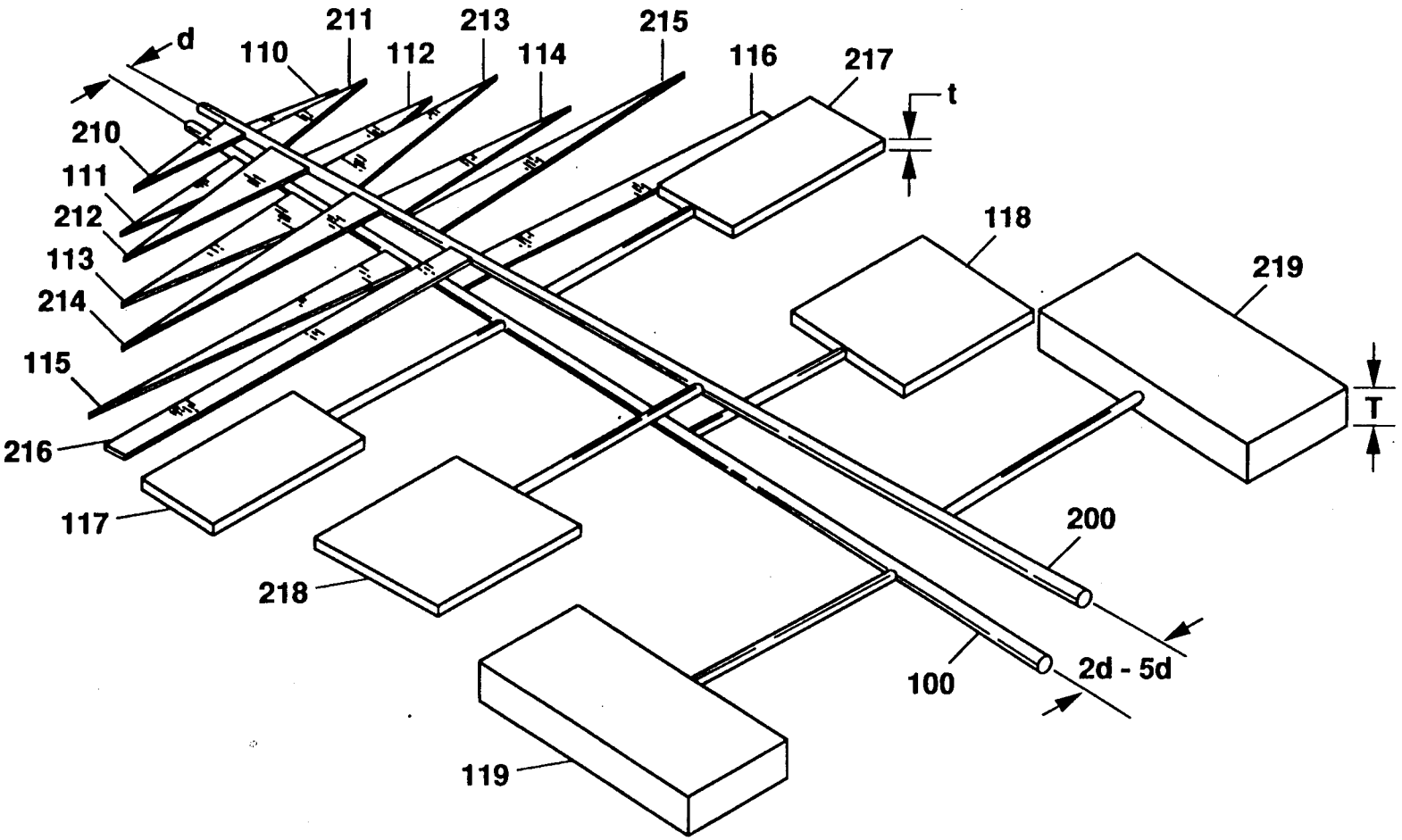
FIG. 4 is a perspective view of an antenna embodying the invention with a tapered coaxial feedline.

In alternative embodiments, performance at the lower operating frequencies can be improved by varying the characteristic impedance of the feedline. One approach to this technique is depicted in FIG. 4, which shows a foreshortened dipole antenna constructed with a coaxial feedline. When coaxial cables are used as the feedline, the characteristic impedance can be tailored by varying the axial spacing of the feedline along the length of antenna structure. Such an embodiment is shown in FIG. 4 wherein the axial spacing between coaxial portions 100 and 200 of the feedline varies from a distance "d" at the end nearest region 1 to a distance between 2d and 5d and the end nearest region 4. The top (as viewed) and bottom sections of the antenna are complementary in the sense that their respective colinear dipole elements (110, 210), (111, 211) . . . (118, 218), and (119, 219) are alternately disposed on opposite sides of the respective coaxial portions 100 and 200. As shown, the thickness T is substantially greater than thickness t of dipole 117, 217 and optionally also that of dipole 118, 218.

What is claimed is:

1. In a log periodic antenna having an axis and a pair of axially extending feed lines, a plurality of axially spaced dipoles connected to said feed lines and extending in directions transversely of said axis, certain of said dipoles having lengths $<<\lambda/2$ where $\lambda$ is the wavelength at the resonant frequency of the respective dipole, each of said certain of said dipoles having two identical elements on opposite sides of said axis, each of said elements having a stem connected at one end to one of said feed lines and a rectangular perimetered body spaced in a first direction from one of said feedlines and connected to the end of said stem opposite said one end thereof, the improvement in which the rectangular bodies of at least one of said certain of said dipoles have thicknesses substantially greater than the thicknesses of the rectangular bodies of the remainder of said certain of said dipoles.

2. The antenna according to claim 1 in which said one of said certain of said dipoles has the lowest resonant frequency of all of said dipoles.

3. The antenna according to claim 2 in which the thickness of said one of said certain of said dipoles is at least 0.25" and the thickness of each of the remaining of said certain dipoles is between 0.010" and 0.015".

4. The antenna according to claim 2 in which the thickness of said one of said certain of said dipoles is at least 0.25", and the thicknesses of each of the remaining of said certain of said dipoles is between 0.25" and 0.010".

5. The antenna according to claim 2 in which the remainder of said certain of said dipoles comprises two dipoles, one of said two dipoles having a thickness of approximately 0.120" and the other having a thickness of about 0.010".

6. The antenna according to claim 1 in which more than one of said certain of said dipoles has a thickness substantially greater than the remainder of said certain of said dipoles.

* * * * *